United States Patent [19]

Rometsch

[11] Patent Number: 4,850,415

[45] Date of Patent: Jul. 25, 1989

[54] GATHERING DEVICE FOR RAISING AND LOWERING A GATHERED CURTAIN

[75] Inventor: Dieter Rometsch, Hamburg, Fed. Rep. of Germany

[73] Assignee: K. Bratschi, Bern, Switzerland

[21] Appl. No.: 47,385

[22] Filed: May 8, 1987

[30] Foreign Application Priority Data

Oct. 10, 1986 [DE] Fed. Rep. of Germany ..... 3634547

[51] Int. Cl.[4] ..... A47H 5/032

[52] U.S. Cl. ..... 160/84.1; 160/331

[58] Field of Search ..... 160/84 R, 243, 309, 160/310, 311, 319, 321, 331, 170, 171, 340, 341

[56] References Cited

U.S. PATENT DOCUMENTS

| | | | |
|---|---|---|---|
| 1,084,781 | 1/1914 | Behrle | 160/84 R |
| 1,407,248 | 2/1922 | Brown | 160/84 R |
| 2,676,654 | 4/1954 | Vallen | 160/331 |
| 2,687,769 | 8/1954 | Gershuny | 160/170 |
| 3,934,832 | 1/1976 | Zilver | 160/319 X |
| 4,062,519 | 12/1977 | Jacobs | 160/331 |
| 4,424,852 | 1/1984 | Hopper | 160/309 |
| 4,610,290 | 9/1986 | Dorflinger | 160/84 R |

*Primary Examiner*—Ramon S. Britts
*Assistant Examiner*—David M. Pubol
*Attorney, Agent, or Firm*—Hurt, Richardson, Garner, Todd & Cadenhead

[57] ABSTRACT

The invention relates to a gathering device for raising and lowering a gathered curtain, having gathering rollers distributed along the horizontal length of the curtain, the rollers are provided with pull elements that can be wound up for raising and unwound for lowering the gathered curtain. The gathering rollers are rotatable by a common drive element about their roller axles. The roller axles of the gathering rollers in the vicinity of the ceiling extend crosswise to the longitudinal direction of the curtain. The gathering rollers are also connected to coaxial drive rollers in a manner fixed against relative rotation. The drive rollers associated with the gathering rollers are actuated by the drive element, which is embodied such that it can be wound up and which extends onward from one drive roller to the next drive roller, this one drive element acting in a cable-like or chain-like fashion on the drive rollers.

13 Claims, 2 Drawing Sheets

Fig.3a
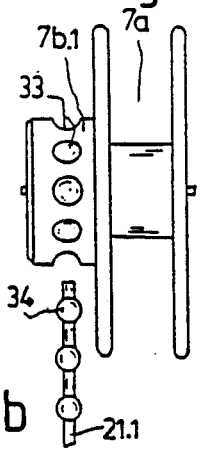
Fig.3b
Fig.3c
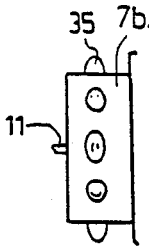
Fig.3d
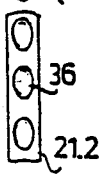
Fig.3e
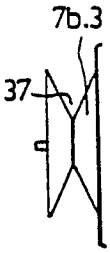
Fig.3f
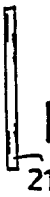
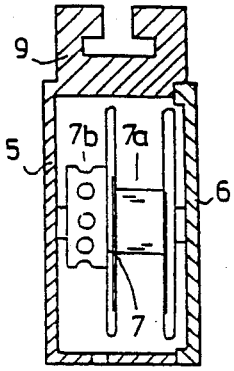
Fig.4
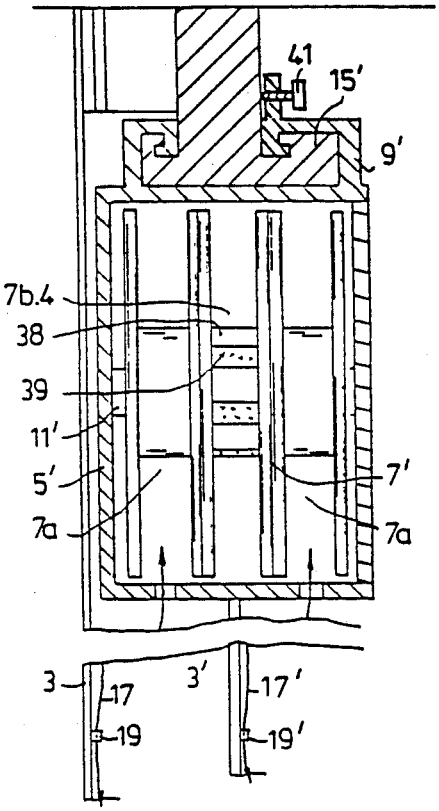
Fig.5

GATHERING DEVICE FOR RAISING AND LOWERING A GATHERED CURTAIN

BACKGROUND OF THE INVENTION

The invention relates to a gathering device for raising and lowering a gathered curtain, which has gathering rollers distributed over the horizontal length of the curtain. These gathering rollers are provided with pull elements that can be wound up for raising and lowering the gathered curtain and are rotatable by a common drive element about their roller axles.

A device for raising and lowering a gathered curtain is known from German Offenlegungsschrift No. 33 05 300. This device comprises gathering rollers spaced apart from one another, distributed over the horizontal length of the curtain. The gathering rollers are secured via bearing blocks, for instance on a curtain rail. The axles of the gathering rollers extend in the longitudinal direction of the curtain or curtain rail. All the rollers are disposed such that they are secured against relative rotation on a winding shaft that is supported in the bearing blocks and is extended to one to one longitudinal end of the curtain. Located on one longitudinal end of the curtain is a wind-up roller, the axle of which is in alignment with the winding shaft. The wind-up roller may for instance be equipped with a cord, preferably a cord having spaced ball like elements secured thereto. The cord hangs downward from the wind-up roller into an area that is within reach of the person manipulating the curtain. This kind of wind-up device, comprising the wind-up roller and the cord, can also be replaced with a drive motor that acts directly upon the wind-up roller.

A device of this kind entails extraordinarily high engineering effort, and it is also heavy in weight. Sturdy securing means are needed and it has to be installed with very good alignment, to prevent the wind-up shaft from sticking in the bearings of the bearing blocks. Even so, such expensive devices are sluggish in operation. A particular disadvantage is that with the known design, only a single curtain layer can be gathered.

OBJECT AND SUMMARY OF THE INVENTION

It is an object of the invention to devise a device for raising and lowering a gathered curtain which is made up of simple parts that allow notable tolerances and the installation of which presents no problems so that even non-professionals can easily install the device.

This object is attained in accordance with the invention in that the roller axles of the gathering rollers in the vicinity of the ceiling extend crosswise to the longitudinal direction of the curtain, the gathering rollers are connected to coaxial drive rollers in a manner fixed against relative rotation to make roller sets, the roller sets are seatable without a rigid mutual connection, and the drive rollers are rotatable by the drive element, which is embodied such that it can be wound in the manner of a cable or chain, and which extends onward from one drive roller to the next.

The substantial advantage of this device is the disposition of the roller axles perpendicular to the longitudinal direction of the curtain. In this manner, it becomes possible to change from the previously typical rigid wind-up shaft to a windably embodied drive element. The rigid connection between the individual gathering rollers is thereby eliminated. One drive roller is coaxially joined to each gathering roller, and the windable drive element is now wrapped around this drive roller. This wrapping around each drive roller is continued from one drive roller to the next until the drive roller located the farthest away from the pull end is reached. When the curtain is fully let down, this drive roller is capable of holding the entire pull length wound up on it. If the gathered curtain is raised, then the drive element is unwound again from this drive roller and drops onto the floor, for instance at the side of the curtain. It can also be wound up again on the pull side, however. Thus the drive element is pulled along the curtain first in one direction and then in the other direction as the curtain is raised and lowered.

According to a further feature of the invention, a diverting device is provided, by means of which the drive element can be diverted in such a way in the raising and lowering direction of the curtain that the windable drive element acting horizontally between the gathering rollers is suspended downward by means of the diverting device, and the downwardly hanging part acts as an actuating part. By means of the diversion of the drive element, this element can simultaneously be used for raising and lowering, that is, by pulling the drive element downward behind the diverting device when raising the curtain and releasing it to roll freely upward when lowering the curtain.

According to another features of the invention, the drive rollers are provided with spherical depressions for "ball cords", or with teeth for chain tapes, or with wedge guides or adhesive surfaces for cords, and either a wrapping around of or tangential contact with the drive rollers is provided. Naturally, other drive means are also conceivable. For a simple embodiment, all that is necessary is that the individual drive rollers be reliably manipulated in common with each another.

According to another feature of the invention, a plurality of gathering rollers are connected with one drive roller such that they are secured against relative rotatation but are rotatable in common with one another. By using a plurality of gathering rollers in combination with only one drive roller, it is possible to have a curtain with several layers and hence a much more interesting curtain design. If a plurality of curtains are hanging one behind the other, then one curtain can be gathered with one roller of a roller set at a time, and the other curtain can be gathered with the other roller of the roller set. Naturally, in that case different gathering heights are also conceivable.

In a further feature of the invention, the drive rollers are attachable, that is, they can be "stuck" or "slipped" or "pushed" onto the gathering rollers. In this way, drive rollers of the particular kind desired can be combined with the gathering rollers. It is also advantageous that the roller sets, comprising at least one gathering roller and the drive roller, are disposed in a housing that can be closed with a cap. By disposing the roller sets in the housings, the sets are protected from dust and also have an attractive appearance. A further advantage is that in accordance with another feature of the invention the roller axles, or the housings receiving the roller sets, can be suspended from a curtain rail. The individual housings can thus be either slipped onto the curtain rail, or pivotably connected to it. By locking them at a desired location of the curtain rail, slippage is avoided.

In another feature of the invention, the diverting device comprises a separately supported single roller, over which the drive element extended on to the drive rollers is diverted downward. By means of this kind of single diverting roller, the drive element is simply suspended downward and part of it falls on the floor. To avoid this, a further feature of the invention provides that between the single diverting roller and the first subsequent drive roller, an additional drive roller is provided with a wind-up roller secured against relative rotation with it; when the curtain is drawn, the drive element rotates the wind-up roller at the same time as the gathering rollers, and its downwardly hanging part is drawn upward again and wound up by the wind-up roller, forming a pull loop. While the individual diverting roller causes the drive element to hang downward, the wind-up roller winds it back up again at the same time, forming a low-hanging loop. In that case, no part of the drive element will fall on the floor. A further advantage is that pulling can always be done in the downward direction. If the gathered curtain is to be raised, then the part of the drive element hanging down from the single diverting roller is pulled, while if the curtain is to be lowered, the part of the drive element hanging down from the wind-up roller is pulled.

Manual operation can also be replaced by motor operation, however, for instance if in accordance with a further feature of the invention the first drive roller or an additional drive roller preceding it is drivable by an electric motor.

The invention will be better understood and further objects and advantages thereof will become more apparent from the ensuing detailed description of preferred embodiments taken in conjunction with the drawings.

BRIEF DESCRIPTION OF THE DRAWINGS

FIG. 3*a* shows a roller set comprising a gathering roller and a drive roller, the latter being provided with a ring having spherical depressions for effecting driving by means of a ball cord;

FIG. 3*b* shows a ball cord for the drive roller of FIG. 3*a;*

FIG. 3*c* shows a modified drive roller with sprocket wheel teeth;

FIG. 3*d* shows a chain tape for the sprocket wheel of FIG. 3*c;*

FIG. 3*e* shows a drive roller in the manner of a V-type pulley;

FIG. 3*f* shows a cord suitable for the V-type pulley;

FIG. 4 shows a gathering roller disposed in a housing and combined with a drive roller of FIG. 3*a* in a housing that can be slipped onto a curtain rail; and FIG. 5 shows a gathering roller set, comprising two gathering rollers and one drive roller between them, with an adhesive area for the actuation of curtains hanging one in front of the other.

DESCRIPTION OF THE PREFERRED EMBODIMENTS

Figure 1:
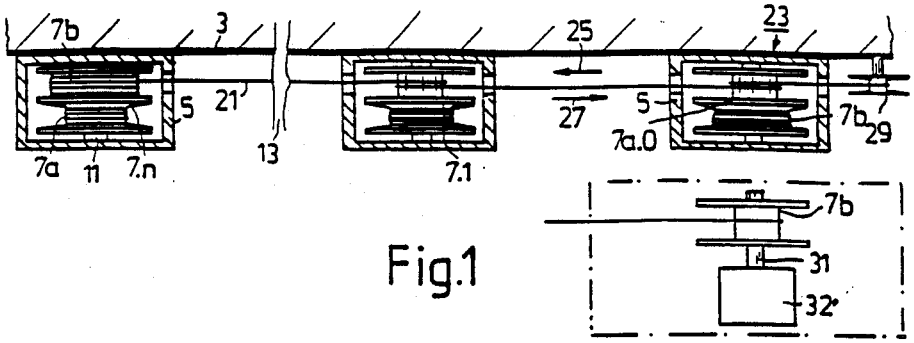
FIG. 1 shows a section taken through a gathering device for a gathered curtain along the line I—I in FIG. 2, with roller sets the axles of which extend crosswise to the longitudinal direction of the curtain, and with a windable embodied drive element for actuating the rollers.

FIG. 1 is a sectional view of a wall or window of a building, not shown, before which a curtain 3 is hung. Sets of rollers 7 are disposed in housings and distributed over the horizontal length of the curtain. The housings 5, as shown more clearly in FIG. 4, are provided with bearing-block-like hanger heads 9, which can be slipped onto or clipped to a curtain rail, for instance a T-shaped curtain rail.

In the embodiment of FIG. 1, the roller sets comprise two rollers that are rotatable about a roller axle 11 and are joined to one another such that they are secured against relative rotation. One roller 7*a* acts as a gathering roller, and one roller 7*b* acts as a drive roller. The two rollers may be integral with one another or embodied such that they can be attached to one another. For gathering a gathered curtain, a plurality of roller sets 7 disposed in housings 5 are needed. The two roller sets shown on the left may be considered to represent the first and last gathering roller sets, between which a plurality of other roller sets are also distributed. This is represented by the broken line 13.

Figure 2:
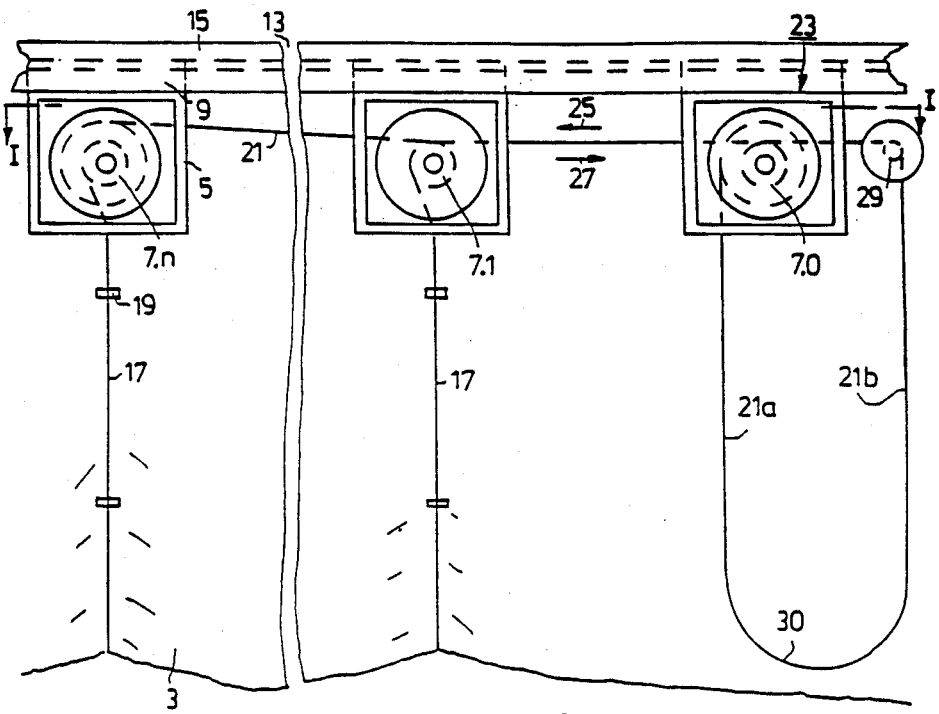
FIG. 2 is a side view of the gathering device with individual gathering roller sets, which are disposed in housings and suspended by them in a curtain rail when the housing cap is opened.

In the view shown in FIG. 2, the housings 5 and roller sets 7 are shown opened, from the front. The curtain rail 15 into which the hanger heads 9 of the housings are inserted is visible above the housings. Hanging behind the roller sets 7 and housings 5 is the gathered curtain 3, which can be gathered via gathering tapes 17. The gathering tapes are guided on the gathered curtain by means of loops 19 and secured at the bottom of the curtain so that the curtain is pulled up from the bottom and gathered horizontally from the bottom up.

The gathering tapes 17 are disposed on the gathering rollers 7*a* and are unwound from the gathering rollers when the gathered curtain is lowered. When the gathered curtain 3 is raised, they are wound up onto the gathering rollers 7*e*. This winding is done with the aid of a windable drive element 21. This drive element 21, which may be a cord, a ball cord, a chain tape or the like, is operated by the diverting device 23 shown on the right in FIGS. 1 and 2. If the gathered curtain 3 is lowered, then the drive element 21 is released by the diverting device 23, and the drive element moves to the left as shown by an arrow 25. The drive element is wrapped at least one time around the drive roller 7*b* of the first roller set 7.1 and extends over the further roller sets as far as the roller set 7.n. There, it is wound up when the gathered curtain 3 is lowered. By suitable dimensioning of the wind-up core of the drive roller 7*b* of the roller set 7.n, it is assured that all the drive rollers 7*b* rotate at the same speed. The gathered curtain 3 is thus lowered uniformly via the gathering tapes 17 across the entire width of the curtain. When the gathered curtain 3 is raised, the pulling direction of the drive element 21 is reversed. For raising the gathered curtain 3, the drive element is thus drawn toward the diverting device 23, in the direction of an arrow 27.

The diverting device 23 comprises a roller set 7.0, for example, which may be of the same type as the roller sets 7.1–7.n. Additionally, a single diverting roller 29 is provided. The cord-like or chain-like drive element 21 wraps around the drive roller 7*b*, first, and then is extended on to the diverting roller 29, from which it then hangs vertically downward. Via a loop 30, the end of the drive element is then raised again and wound up on a gathering roller 7*a*.

If the gathered curtain 3 is to be lowered, then the person operating the curtain pulls the part 21*a* of the drive element 21 downward. The drive element 21 then moves in the direction of the arrow 25 and rotates the roller sets 7.1–7.n in the unwinding direction for the gathering tapes 17. If the gathered curtain 3 is to be raised, then the operator pulls on the part 21*b* of the drive element 21. The drive rollers 7*b* for the gathering tapes 17 are now rotated in the winding-up direction, and the gathered curtain 3 rises.

In FIG. 1, only one drive roller 7*b* is shown in the housing box drawn in broken lines. Via a shaft 31, this drive roller 7*b* is operated by means of an electric motor 32. With the aid of the electric drive, the drive element is pulled back and forth between the roller 7*b* upon which the motor 32 acts and the roller 7*b* of the roller set 7.n to raise and lower the gathered curtain.

From FIGS. 1 and 2, the advantage of this construction is clear, that is, that only some roller sets 7 disposed in housings 5 are necessary for actuating the gathered curtain, the sets being clamped onto a curtain rail 15 independently of one another. The diverting device 23, by way of which the individual roller sets 7.1–7.n are actuated, as soon as the cord-like or chain-like drive element 21 is pulled in, is then clamped in place on one side of the curtain, for instance on the right as seen in the drawing. This kind of arrangement is very simple and easily installed.

FIGS. 3*a*, 3*c* and 3*e* show variants of the roller sets 7.1–7.n, and FIGS. 3*b*, 3*d* and 3*f* show drive elements suitable for them. For FIGS. 3*a*, 3*c* and 3*e*, the gathering rollers 7*a* are all embodied identically. Different types of drive rollers 7*b*.1, 7*b*.2 and 7*b*.3 are mounted on them, however. The drive roller 7*b*.1 has a cylindrical element comprising spherical depressions 33, while the drive roller 7*b*.2 has a cylindrical element with teeth 35, and the drive roller 7*b*.3 is embodied as a V-type pulley, with a V-shaped trough 37. To actuate the roller set having the spherical depressions 33 on the drive roller 7*b*.1, a ball cord 21.1 is used, in which balls 34 are incorporated, spaced apart by a spacing matching that of the depressions 33, as shown in FIG. 3*b*. For actuating the drive roller 7*b*.2, a chain tape 21.2 shown in FIG. 3*d* and having openings 36 is used. For actuating the drive rollers 7*b*.3 embodied as V-type pulleys, a cord 21.3 as shown in FIG. 3*f* is used. Naturally, other means of transmitting the drive are also conceivable; for instance, FIG. 5 shows the drive roller 7*b*.4 embodied similarly to a gathering roller 7*a* and having an adhesive strip 39, in the form of a fine Velcro ® strip or adhesive area, on its wind-up core 38.

FIG. 4, in section, shows a housing 5 that receives a roller set 7. The housing is then equivalent to the one shown in FIGS. 1 and 2 and has a hanger head 9, which can be clamped onto a T-shaped rail. Naturally the hanger head may instead be embodied for insertion into a U-shaped rail. The housing 5 is provided on its front with an attached cover 6. The housing 5 with the hanger head 9 and the cover 6 are preferably injection molded plastic parts but may be metal.

FIG. 5 shows another variant, by means of which a much greater variety of gathered curtains can be designed, for instance comprising a plurality of single curtains hanging one in front of the other. To this end, a roller set 7′ is inserted into the housing 5′ of FIG. 5, this set 7′ comprising the central drive roller 7*b*.4 and two gathering rollers 7*a* flanged on to the side such that they are secured against relative rotation. The roller set 7′ is guided in the housing 5′ via a roller axle 11′. A hanger head 9′ on the housing 5′ is fitted to a special type of T-shaped curtain rail 15′. The gathered curtain 3 is raised and lowered via the gathering tape 17, which is represented here merely by a double arrow one for each roller section. A further gathered curtain 3′, which hangs in front of the gathered curtain 3, is actuated with the aid of gathering tapes 17′ of the front gathering roller 7*a*. In FIG. 5, the gathering tapes 17 and 17′ for the gathered curtains 3 and 3′ are shown guided in loops 19 and 19′.

To assure secure clamping of the housings 5 and 5′ to the curtain rails 15 and 15′, clamping screws 41 are provided, which press against the T-shaped rails 15 and 15′ from the hanger heads 9 and 9′. It is not shown in the drawing that the roller sets 7 and 7′ in the housings 5 and 5′ are provided with a self-locking means, if necessary.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A gathering device for raising and lowering a gathered curtain suspended from a curtain rail comprising at least two housing means secured to the rail and disposed at intervals along the horizontal width of the curtain, axle means having gathering rollers disposed thereon, said axle means being rotatably mounted in connection with said housing means and having an axis disposed perpendicularly relative to said curtain, drive rollers mounted on said axle means and being fixed thereon for relative rotation with said gathering rollers, pull elements having one end secured to said gathering rollers and an opposite end secured to said curtain, and an endless drive element engaged with said drive rollers and operable for rotating said drive rollers and said gathering rollers for raising and lowering said curtain with said pull elements.

2. A gathering device as defined in claim 1, further comprising a diverting roller mounted near one of said drive rollers and engaging said drive element, said drive element being suspended downwardly from said diverting roller and said one of said drive rollers for forming a pull loop for effecting operation of said drive rollers.

3. A gathering device as defined in claim 1 in which said device includes a plurality of said housing means, said gathering rollers, and said drive rollers, disposed at intervals along the horizontal width of said curtain.

4. A gathering device as defined in claim 3 in which said drive rollers include means for positively engaging said drive element.

5. A gathering device as defined in claim 1 in which said drive rollers include means for positively engaging said drive element.

6. A gathering device as defined in claim 5 in which said gathering and drive rollers are disposed in said housing means and said housing means includes a removable cover for providing access to said rollers and to said pull and drive elements.

7. A gathering device as defined in claim 1 in which said device includes a motor and power source operatively connected to said drive element for actuating said rollers.

8. A gathering device for raising and lowering a gathered curtain comprising a housing means with a plurality of gathering rollers being singly disposed therein at intervals along the horizontal width of said curtain, said gathering rollers each having an axle disposed in said housing means in perpendicular relationship to the horizontal plane of said curtain, a plurality of drive rollers being singly and coaxially mounted with said gathering rollers and also being fixed for relative rotation therewith, a diverting roller having an endless drive element disposed thereon and operatively connected with said drive rollers for rotation therewith upon movement of said endless drive element, and pull elements secured at one end to said gathering rollers and at the opposite end to said curtain for raising and lowering said curtain upon operation of said diverting roller with consequent operation of said drive and gathering rollers.

9. A gathering device as defined in claim 8, in which said diverting roller is mounted near one of said drive rollers and engages said drive element, said drive element being suspended downwardly from said diverting roller and said one of said drive rollers for forming a pull loop for effecting operation of said drive rollers.

10. A gathering device as defined in claim 9 in which said drive rollers include means for positively engaging said drive element.

11. A gathering device as defined in claim 8 in which said drive rollers include means for positively engaging said drive element.

12. A gathering device as defined in claim 8 in which said gathering and drive rollers are disposed in said housing means and said housing means includes a removable cover for providing access to said rollers and to said pull and drive elements.

13. A gathering device as defined in claim 8 in which said device includes a motor and power source operatively connected to said drive element for actuating said rollers.

* * * * *